United States Patent [19]

Ho et al.

[11] 3,991,552

[45] Nov. 16, 1976

[54] DIGITAL WATCH WITH LIQUID CRYSTAL DISPLAY

[75] Inventors: Ernest C. Ho; Norman E. Moyer, both of Newport Beach; Richard J. Belardi, Anaheim, all of Calif.

[73] Assignee: Hughes Aircraft Company, Culver City, Calif.

[22] Filed: Oct. 17, 1974

[21] Appl. No.: 515,797

Related U.S. Application Data

[63] Continuation-in-part of Ser. No. 364,794, May 29, 1973, abandoned.

[52] U.S. Cl. ..... 58/4 A; 58/50 R; 58/58; 240/6.43; 340/336

[51] Int. Cl.[2] ..... G04B 19/24; G04B 19/30; G04C 17/02; H05B 35/00

[58] Field of Search ..... 58/4 A, 23 R, 50 R, 58/58

[56] References Cited

UNITED STATES PATENTS

| | | | |
|---|---|---|---|
| 3,765,163 | 10/1973 | Levine et al. | 58/23 A |
| 3,823,551 | 7/1974 | Riehl | 58/23 R |

*Primary Examiner*—E. S. Jackmon
*Attorney, Agent, or Firm*—Fay I. Konzem; W. H. MacAllister

[57] ABSTRACT

A digital watch system includes a crystal controlled oscillator with frequency division which controls a set of counters, each counter carrying coded horological data. Selected counter set data is multiplexed into a seven segment decoder. The decoder output is demultiplexed into memories, one for each of the segments in each of the display digits. The memories control segment drivers for the liquid crystal digital displays.

5 Claims, 2 Drawing Figures

DIGITAL WATCH WITH LIQUID CRYSTAL DISPLAY

This is a Continuation-In-Part of Application Ser. No. 364,794, filed May 29, 1973.

BACKGROUND OF THE INVENTION

This invention is directed to a digital watch which employs a multiplex signal processing circuit on a C/MOS chip with a liquid crystal digital horological display.

The employment of an electronic oscillator to produce pulses which are processed to drive a digital watch display is broadly old. There are a number of publications on this subject, and these include an article entitled "C/MOS Digital Wrist Watch Features Liquid Crystal Display" by N. A. Luce, *Electronics*, Apr. 10, 1973, pages 93 through 97. Another short news item is entitled "TI's Liquid Crystal Set for Digital Watch" which appears in *Electronics*, Apr. 24, 1972, at page 42. A review or overview article entitled "The Electronic Watch" by Marce Eleccion appears in *IEEE/Spectrum*, April 1973, at pages 24 through 32. The two *Electronics* articles teach that liquid crystals must be continuously energized, and thus there must be a liquid crystal display device for each of the types of information which are to be displayed. Thus, when a large number of displays are desired, as in the Apr. 24, 1972 *Electronics* article, the electronic circuitry must continually process all of this information to maintain the display. The continuously operating circuitry within the watch must be adequate and complete enough to continuously calculate and store all of this information and also drive the display itself.

With light emitting diode displays, it was found that multiplexing of signals could be employed to reduce the circuit complexity by reducing the number of decoders between the counters and the light-emitting diode displays. This is because the multiplexing of the signal, while causing high cyclic rate energization of the light-emitting diodes, still provides an acceptable diode output signal. However, at present liquid crystals cannot be driven directly from a multiplexed signal, because each segment requires continuous drive.

SUMMARY OF THE INVENTION

In order to aid the understanding of this invention, it can be stated in essentially summary form that it is directed to a digital watch with liquid crystal display of horological information, particularly with manually operable selectors on the watch so that the character of the output information displayed by the liquid crystal display can be selected. In some conditions of the manual selectors, a particular type of information is displayed. In other conditions of the selectors, other horological information is displayed upon the same liquid crystal displays.

Accordingly, it is an object of this invention to provide a digital watch with liquid crystal display devices for continuous display of horological information and the type of information being displayed upon the particular liquid crystal display device is a function of manual selection. It is another object to provide a digital watch wherein manually operable switches control the horological information which will be displayed upon the liquid crystal display. It is a further object to employ an oscillator, together with frequency dividers and counters to provide a plurality of different kinds of horological information which can be selectively displayed upon a single liquid crystal display set. It is a further object to provide a multiplexing arrangement in connection with horological information counters together with counter information decoders so that the number of decoders can be reduced through multiplexing. It is a further object to provide a digital watch circuit which includes a decoded and multiplexed series of horological signals which are thereupon demultiplexed and fed to memory units for each portion of the display so that the memories each control drive to their own portion of the display in accordance with the multiplexed information.

Other objects and advantages of this invention will become apparent from the following portion of the specification, the claims, and the attached drawings.

DETAILED DESCRIPTION

Figure 1:
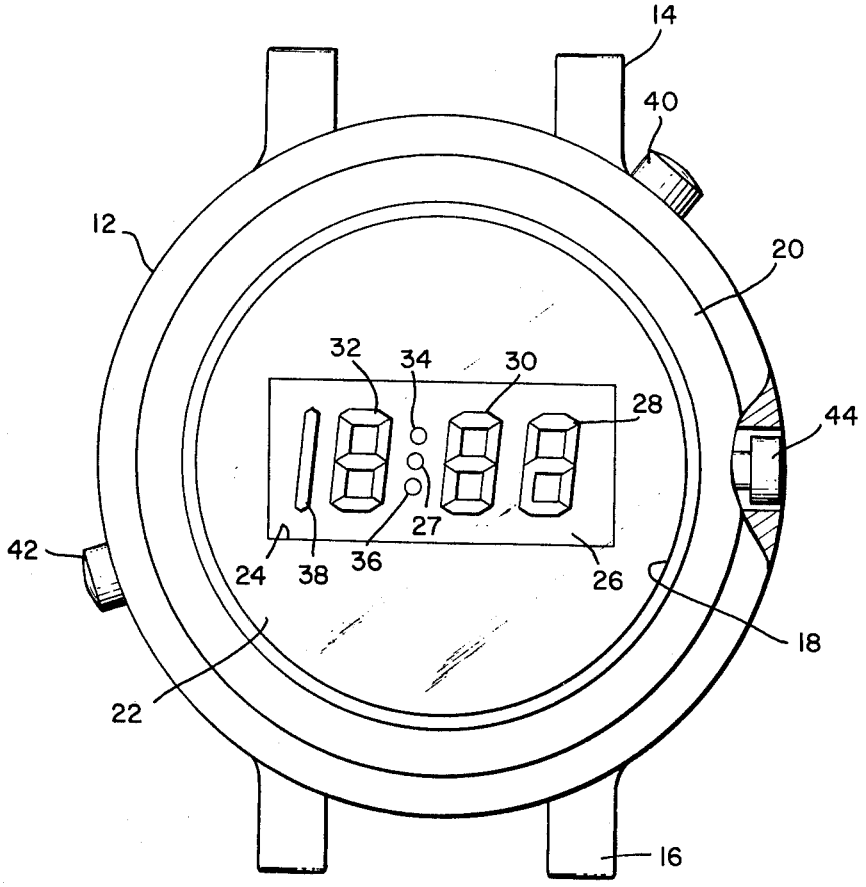
FIG. 1 is a top-plan view of a digital watch with a liquid crystal display which selectively displays different horological information, in accordance with this invention.

FIG. 1 shows a watch 10 which embodies the selective display circuitry and the liquid crystal display of this invention. Watch 10 has a case 12 which is provided with watch strap-securing ears 14 and 16. The securing ears 14 and 16 are of such nature that the usual watch strap can be attached thereon so that watch 10 can be carried upon the wrist of the wearer. In the preferred embodiment, the watch 10 is thus a wristwatch, although the same construction circuitry and display can be employed in a pocket watch. The watch includes the employment of a continuously driven liquid crystal display together with electronics of such compact size that the electronics can be carried in the watch. Crystal 18 is mounted in bezel 20 on the front of the watch. Through the crystal can be seen a mask 22 which has display-viewing window 24 therein. Mask 22 can have decoration thereon, if desired. Furthermore, crystal 18 can be of such color filter material as is desirable to enhance the contrast of the display.

The digital watch of this invention utilizes a 3½ or 4-digit liquid crystal watch display which remains on continuously, displaying hours and minutes, (in the preferred embodiment) except when commanded by a pushbutton. When it is desired to display either the date of the month, the month and date, or the seconds, the hours-minutes display is blanked out and the date, month, or seconds is selectively displayed by selectively actuating pushbuttons. If desired, an additional pushbutton 25 may be used to turn on a small light-emitting diode 27 position near the center of the display which will readily permit the viewing of the liquid crystal display in darkness. Thus, the digital watch of this invention displays the hours and minutes continuously, but still permits the occasional displaying of the seconds or date on the same display devices. This eliminates the necessity for providing additional display devices on the watch and the appropriate connections therefor. Such additional display areas would detract from the appearance of the watch. In addition to sharing the same display, the electronic complexity is greatly reduced by use of the same shared display and connections therefor. If separate displays were required, a larger and more costly MOS chip and hybrid substrate would be required. This would result in more bonding wires with the labor costs thereof and the reduction in reliability. Thus, the digital watch described below employs a liquid crystal which continuously displays the hours and minutes so that such may be readily read, but also provides other horological information upon command.

Viewed through the display-viewing window 24 is liquid crystal module 26 which contains liquid crystal display devices 28, 30, and 32. Each of these display devices is a standard 7-segment liquid crystal display which is of such nature that, when the selected segments, seen in FIG. 1, are energized, the ten digits from zero through nine can be selectively represented. Additionally, substrate 26 carries points 34 and 36 thereon. These are arranged in the positioning of a colon between devices 30 and 32. Furthermore, substrate 26 carries display device 38 thereon. Display device 38 is configured so that it appears like numeral 1 in front of the display device 32. The display devices 28, 30, 32, and 38 are often called a 3½ digit display.

Watchcase 12 carries manually operable pushbuttons 40 and 42, which are easily accessible. Furthermore, case 12 carries recessed pushbutton 44 which can be depressed by a pointed object. In accordance with the functional requirements, more or less pushbuttons can be employed for the purpose of controlling the watch. The physical structure of the substrate 26 upon which the display devices are mounted and the relationship of the pushbuttons 40, 42, and 44 to the substrate and to the circuit are disclosed in detail in the I. B. Merles and R. F. Zurcher application Ser. No. 343,319, filed Mar. 21, 1973. Said patent application assigned to the same assignee as the present patent application, Hughes Aircraft Company.

Figure 2:
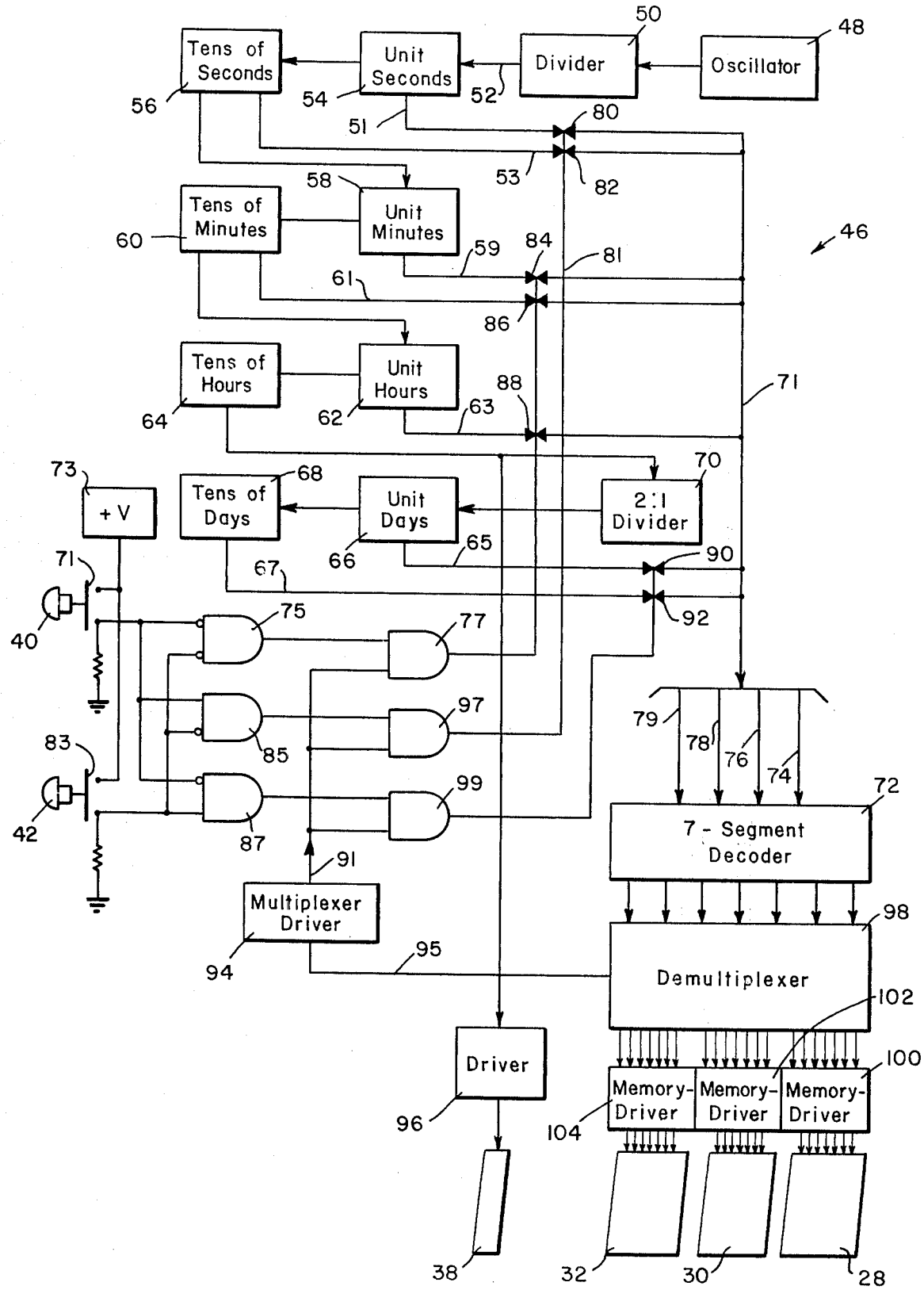
FIG. 2 is a block diagram of the circuitry of the watch of this invention.

FIG. 2 illustrates the electronic circuit 46. The components illustrated in circuit 46 are structural circuits which perform particular functions, as described below. Oscillator 48 is an electronic oscillator which is crystal-controlled to oscillate at a predetermined and substantially constant frequency. It, as well as the other circuits of this invention, are powered by batteries so that the entire structure can be mounted in a wristwatch. Several or all of the subcircuits can be and preferably are contained on the same C/MOS chip to minimize interconnections, minimize assembly labor and chances of misassembly, minimize size, and provide a watch of maximum reliability. The output of oscillator 48 goes to divider 50. Divider 50 is any convenient type of divider well-known in the art. The output of divider 50, in line 52, is at a one-per-second frequency. Counter 54, as well as counter 56 are conveniently binary coded decimal counters. Four successive binary bits successively represent 8, 4, 2 and 1 so that values from zero through nine (and above to 15) can be represented by four bits. These counters are individually designed so that, when each exceeds its predetermined maximum count, it resets to zero and transmits a signal to the next slower counter.

The one second pulses in line 52 are counted by the unit-seconds counter 54 until nine is reached. Thereupon, the unit-seconds counter 54 resets to zero and emits a signal to tens-of-seconds counter 56. Each 10 seconds, counter 56 receives a pulse and advances its count by 1. When the signal to advance the count beyond 5 is received, tens-of-seconds counter 56 resets to zero and emits a pulse to unit-minutes counter 58.

Similarly, every minute unit-minutes counter 58 emits a signal to tens-of-minutes counter 60. When tens-of-minutes counter 60 receives a signal to advance beyond 5, it resets to zero and sends a signal to unit-hours counter 62. Again, each hour, the unit-hours counter 62 emits a signal to tens-of-hours counter 64.

The present disclosure contemplates a 12-hour watch. Therefore, the tens-of-hours counter controls the tens-of-hours "number 1" display device 38, and does not need to count beyond that value. It is a special counter which is controlled by the unit-hours counter 62 to illuminate the tens-of-hours display device 38 for the 10th, 11th, and 12th hours. Thereupon, it resets. Similarly, it is interconnected with the unit-hours counter 62 so that, when the tens-of-hours counter 64 resets at the end of the 12th hour, the unit-hours counter 62 does not reset to zero, but resets to 1. Thus, there is mutual intercontrol between counters 62 and 64.

The output signal from tens-of-hours counter 64 occurs twice a day. This output is connected through divider 70 to the input of unit-days counter 66. Therefore, the unit-days counter 66 advances only once per day.

Divider 70 thus stores the information as to whether or not it is ante-meridian or post-meridian. If desired, this information can be used to selectively make visibly distinctive devices 34 and 36. For example, when device 34 is visible, it is the a.m. time period. Conversely, when device 36 is visible, it is the p.m. time period. Alternatively, one of the devices 34 and 36 can be visible in one time period and both visible in the other so that, when they are both visible, they appear to be a colon between the hours and minutes devices.

Unit-days counter 66 thus receives a signal every day and emits a signal evey ten days. Tens-of-days register counter 68 need only reach 3, and thus does not need all of the binary coded decimal circuits to make it sufficiently complete to perform the other tasks. Tens-of-days counter 68 is linked to unit-days counter 66 so that, when the total attempts to pass 31 days, counter 68 resets to zero and counter 66 resets to one. It should be noted that tens-of-hours counter 64 and tens-of-days counter 68 do need a zero signal output. When they are set at zero, no output to the display devices is required.

Seven-segment decoder 72 is a device which receives binary coded decimal signals from the counters and emits seven signals which correspond to the seven segments of the devices 28, 30, and 32 so that, when turned on to be visibly distinctive, the segments represent the digit corresponding to the counter state. Since it is desired to display different horological information, it is necessary to switch different counters into the input of the seven-segment decoder. Similarly, since there are three devices 28, 30, and 32 which require decoding, it is convenient to employ a single seven-segment decoder 72, and multiplex the inputs and outputs therefrom.

There are four input buses 74, 76, 78, and 79 to the seven-segment decoder. Each of these buses represent four lines which carry the binary coded decimal information from the counters. Transmission gates 80, 82, 84, and 86, respectively, connect counters 54, 56, 58, and 60 to bus 74. Similarly, transmission gates 88, 90, and 92 respectively connect counters 62, 66, and 68 to bus 74. Similar sets of gates also connect these counters to buses 76, 78, and 79. The gates are all connected to multiplex driver 94. In the preferred embodiment in accordance with this invention, the multiplex driver operates in such a manner that unit minutes are displayed on device 28, tens-of-minutes on device 30, unit hours on device 32, and tens-of-hours on device 38. As previously discussed, the tens-of-hours counter 64 is directly connected through driver 96 to device 38. It does not enter into the function performed by seven-segment decoder 72.

Line 51 from unit-seconds counter 54 is connected to transmission gate 80. Line 51 actually represents four output lines from unit-seconds counter 54 going to four transmission gates represented by one transmission gate 80. In order to simplify FIG. 2, only one line 51 and one transmission gate 80 are shown to represent four. Each of the four lines represented by line 51 carry one of the four bits of information which is delivered via line 71 to the seven-segment decoder 72. The four lines of binary information are represented by input lines 74, 76, 78, and 79 to said decoder 72.

Thus, in normal operation, multiplex driver 94 operates the transmission gates in such a manner that the binary coded decimal bit lines 74, 76, 78, and 79 receive the BCD digital code bit when the unit-minutes counter 58 is connected to the input bit lines by "on" condition of transmission gate 84 and its companions. The output of seven-segment decoder 72 represents the energization of the necessary lines for the seven segments to be displayed in device 28. However, it is necessary to demultiplex the output of seven-segment decoder 72. Demultliplexer 98 has as its input the seven-segment lines and digit select information from driver 94. It has a its output seven- segment lines for each of the devices 28, 30, and 32. Memory drivers 100, 102, and 104 are connected in these lines between the demultiplexer and respectively the devices 28, 30, and 32. Demultiplexer 98 is controlled by multiplex driver 94 so that the seven-segment decoder information is properly distributed to the memory driver devices. The memory drivers continuously energize selected segments.

In operation when the pushbuttons 40 and 42 are unactuated, the output of AND gate 75 is high, so when a high or clock pulse is generated from multiplexer 94, the output of AND gate 77 goes high; thereby opening transmission gates 84, 86, and 88, allowing the information from unit-minutes counter 58, tens-of-minutes counter 60, and unit-hours counter 62 respectively to be delivered to the seven-segment decoder 72 through the demultiplexer 98 through their respective memory drivers and finally to be displayed on liquid crystal elements 28, 30, and 32 respectively.

When a different display is desired, pushbutton 40, for example, is depressed. Pushbutton 40 controls multiplex driver 94 so that the unit-seconds and tens-of-seconds counters 54 and 56 are scanned instead of the minutes and hours counters. In this case, the seconds stored in these counters are displayed. It is preferable to display the unit seconds and tens-of-seconds on devices 28 and 30, respectively, when a 3½ digit display is employed, as in the preferred embodiment shown. Thus, the minutes and hours are not displayed while pushbutton 41 is depressed, but the seconds recorded in the seconds counters are displayed. When pushbutton 40 is depressed, the output 91 from multiplex driver 94 is connected via line 81 to transmission gates 80 and 82 and via lines 51 and 52 respectively to unit- seconds counter 54 and to tens-of-seconds counter 56 respectively. When pushbutton 40 is depressed the output of AND gate 85 goes high so when a high or clock pulse is generated from multiplexer 94, the output of AND gate 97 goes high; thereby opening transmission gates 80 and 82, allowing the information from the unit seconds counter 54 and from tens-of-seconds counter 56 to be delivered via buss line 71 through seven-segment decoder 72 and demultiplexer 98 to the appropriate display devices. Similarly, if display of the date is desired, depressing pushbutton 42 operates multiplex driver 94 so that the unit-days and tens-of-days information stored in counters 66 and 68 are scanned in BCD form and are displayed in devices 28 and 30 in seven-segment form. Furthermore, if additional counters were incorporated, by simple extrapolation from the disclosed counters, the month could be displayed with the day's date. Furthermore, with the use of another pushbutton and appropriate counters, other horological information such as the year could be displayed in similar manner. Pushbutton 44 is employed with plushbuttons 40 and 42 for setting the counters so that the counters carry current time.

When pushbutton 40 is depressed, contact 71 is closed and positive voltage source 73 is electrically connected to a first inverted input to AND gate 75, to a first inverted input to AND gate 85 and to a first input to AND gate 87. The output from AND gate 75 is connected to a first input to AND gate 77. The output from AND gate 85 is connected to a first input to AND gate 97. And the output from AND gate 87 is connected to a first input to AND gate 99. The second inputs to gates 77, 97 and 99 are connected via line 91 to multiplexer driver 94.

When pushbutton 42 is depressed, contact 83 is closed and positive voltage source 73 is electrically connected to a second inverted input to AND gate 75, to a second inverted input to AND gate 85 and to a second input to AND gate 87.

When neither pushbutton 40 nor 42 is depressed transmission gates 84, 86 and 88 are closed and the minutes and hours information are displayed on display elements 28, 30, 32 and 38.

When pushbutton 40 is depressed the output of gates 75 and 87 are a binary low level but the output of gate 85 is a binary high level. Therefore, when a high clock pulse is generated by multiplexer driver 94, via line 91, the output of AND gate 97 is high and transmission gates 80 and 82 are thereby closed to deliver the seconds information to display elements 28 and 30.

And when pushbutton 42 is depressed the output of gates 75 and 85 are low but the output of gate 87 is high. Therefore, when a high clock pulse is generated by multiplexer driver 94, via line 91, the output of AND gate 99 is high and transmission gates 90 and 92 are thereby closed to deliver the days information to display elements 28 and 30.

When pushbutton 42 is depressed, the output of AND gate 87 goes high so when a high or clock pulse is generated from multiplexer 94, the output of AND gate 99 goes high; thereby opening transmission gates 90 and 92, allowing the information from the unit days counter 66 and the tens-of-days counter 68 to be delivered via bus line 71 through the decoder 72 and the demultiplexer 98 to the appropriate display devices. Output 95 from multiplex driver 94 determines which liquid crystal display element will receive the information from the seven-segment decoder 72. Display element 28 receiving the information from the unit-days counter 66 and display element 30 receiving the information from the tens-of-days counter 68, when pushbutton 42 is depressed.

The output from the seven-segment decoder 72 must be demultiplexed to driver the continuous current liquid crystal displays 28, 30, and 32. Memory drivers 100, 102, and 104 continuously energize liquid crystal display elements 28, 30, and 32 respectively. Even when a transmission gate is closed, thereby impeding information from that counter to its display element, the memory driver for that display element will maintain the previous information received from the counter when that counter's transmission gate was last opened.

Output line 95 from multiplex driver 94 actually represents three lines. These three lines go through the demultiplexer 98, one line going to each of the memory drivers 100, 102, and 104. The signal from multiplex driver 94, via line 95, determines which liquid crystal display element 28, 30, or 32 will receive the information from the counters. Display element 28 receiving the digital information from unit-minutes counter 58, display element 30 receiving the information from tens-of-minutes counter 60, and display element 32 receiving the information from unit- hours counter 62.

The information out of demultiplexer 98 is in the form of seven-segment information. However, since the demultiplexer is a switching device, a memory driver is necessary for each of the segment lines to provide continuous power to each of the segments to be illuminated. The memory driver in each of the seven-segment lines to each of the devices can be a simple circuit which has a square wave output, selectively in phase or out of phase with the square wave applied to the liquid crystal display backplate.

Liquid crystal display devices 28, 30, and 32 are of conventional construction. The liquid crystal cell structure is a sandwich module 26. It is connected directly to the metalization circuit on the substrate which in turn is directly connected to the integrated circuit chips. The electrodes are thus integral with the printed circuitry on the substrate and they are thus directly connected to the chips. A nematic liquid is preferred. Liquid crystals are discussed in further detail in M. Braunstein and W. P. Bleha U.S. Pat. No. 3,732,429 and in T. D. Beard and W. P. Bleha Patent Application, Ser. No. 192,406, filed Oct. 26, 1971. Said patent and patent application assigned to the same assignee as the present patent application, Hughes Aircraft Company. The details of the electronic circuitry are disclosed in more detail in Hans G. Dill Application, Ser. No. 268,291, filed July 3, 1972. Said patent application assigned to the same assignee as the present patent application, Hughes Aircraft Company. The subject matter of all outside disclosures referenced in this specification are incorporated herein in their entirety by this reference.

This invention having been described in its preferred embodiment, it is clear that it is susceptible to numerous modifications and embodiments within the ability of those skilled in the art, and without the exercise of the inventive faculty. Accordingly, the scope of this invention if defined by the scope of the following claims.

What is claimed is:

1. An electronic watch structure comprising:

a support, a plurality of liquid crystal display devices mounted upon said support, an electronic circuit mounted on said support for powering said visual display device, said support, said visual display and said electronic circuit being of such size and having such electrical characteristics that they can be carried in a wristwatch and be battery-powered;

said electronic circuit comprising an oscillator and a divider for producing timed pulses of substantially constant period and counters for receiving said pulses and maintaining a plurality of sets of horological information;

a first and second pushbutton connected between said counters and said liquid crystal display devices; and means for causing said liquid crystal display devices to continuously display a first set of horological information when said first and second pushbuttons are unactuated, to display a second set of horological information when said first pushbutton is actuated and a third set of horological information when said second pushbutton is actuated.

2. The electronic watch structure of claim 1 wherein said support is a supporting plate.

3. The electronic watch structure of claim 1 wherein, said display devices comprise seven-segment liquid crystal digit displays and a seven-segment decoder is connected between the said horological information-containing counters and said display devices.

4. The electronic watch structure of claim 3 wherein there is a single seven-segment decoder and said means to display comprises multiplexing means for multiplexing the counters containing the first set of horological information into the seven-segment decoder than said first and second pushbuttons are unactuated and for multiplexing the counters contaning the second set of horological information-containing counters into said seven-segment decoder when said first pushbutton is actuated.

5. The electronic watch structure of claim 4 wherein a demultiplexer is connected between said seven- segment decoder and said seven-segment display devices so that selected segments of said display devices are continuously energized.

* * * * *

UNITED STATES PATENT AND TRADEMARK OFFICE

CERTIFICATE OF CORRECTION

PATENT NO. : 3,991,552

DATED : November 16, 1976

INVENTOR(S) : Ernest C. Ho; Norman E. Moyer and Richard J. Belardi

It is certified that error appears in the above-identified patent and that said Letters Patent are hereby corrected as shown below:

Column 1, line 18, "1973" should read --1972--

Column 2, line 35, "construction circuitry" should read -- construction, circuitry--

Column 2, line 56, "position" should read --positioned--

Column 5, line 62, "41" should read --40--

Column 5, line 66, "52" should read --53--

Column 7, line 4, "driver" should read --drive--

Signed and Sealed this

Thirty-first Day of May 1977

[SEAL]

*Attest:*

RUTH C. MASON
*Attesting Officer*

C. MARSHALL DANN
*Commissioner of Patents and Trademarks*